US010059123B2

(12) United States Patent
Takami

(10) Patent No.: US 10,059,123 B2
(45) Date of Patent: Aug. 28, 2018

(54) PEELING DEVICE AND INK JET PRINTER

(71) Applicant: SEIKO EPSON CORPORATION, Tokyo (JP)

(72) Inventor: Toru Takami, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/634,832

(22) Filed: Jun. 27, 2017

(65) Prior Publication Data

US 2018/0001663 A1 Jan. 4, 2018

(30) Foreign Application Priority Data

Jun. 29, 2016 (JP) ..... 2016-129267

(51) Int. Cl.
*B41J 3/407* (2006.01)
*B65C 9/00* (2006.01)

(52) U.S. Cl.
CPC ..... *B41J 3/4075* (2013.01); *B65C 9/0006* (2013.01); *B41J 3/407* (2013.01); *B65C 2009/0009* (2013.01)

(58) Field of Classification Search
CPC ..... B41J 3/4075; B41J 3/407; B65C 9/0006; B65C 2009/0009
See application file for complete search history.

(56) References Cited

FOREIGN PATENT DOCUMENTS

| | | | |
|---|---|---|---|
| JP | 10-016932 | A | 1/1998 |
| JP | 10-077015 | A | 3/1998 |
| JP | 2002-193227 | A | 7/2002 |
| JP | 2004-262499 | A | 9/2004 |
| JP | 2006-182498 | A | 7/2006 |
| JP | 2010-013109 | A | 1/2010 |
| JP | 2012-188136 | A | 10/2012 |

*Primary Examiner* — Geoffrey Mruk
(74) *Attorney, Agent, or Firm* — Foley & Lardner LLP

(57) ABSTRACT

A peeling device includes a driving roller that transports backing paper and a drive transmission mechanism that transmits driving force from a driving motor to the driving roller. The peeling device also includes a peeling plate (a peeling portion) located between the driving roller, and a printhead and platen (a printing section) in a transport path of the backing paper, and bends the transport path. The drive transmission mechanism includes a first torque limiter and a second torque limiter. The drive transmission mechanism changes to a first state in which the first torque limiter is included between the driving roller and the driving motor in a transmission system of the driving force or a second state in which the second torque limiter is included therebetween.

10 Claims, 10 Drawing Sheets

PEELING DEVICE AND INK JET PRINTER

BACKGROUND

The present disclosure relates to a peeling device and an ink jet printer.

In the related art, some peeling methods have been known for transporting label paper having labels attached thereto with the label paper bent at a peeling portion at an acute angle to peel off the labels. In the peeling method, appropriate tension needs to be applied to the peeling portion. The method for making the driving speed of a roller on the downstream side of the peeling portion faster has been known (JP-A-10-016932, for example) as the corresponding method. Other method also has been known in which a pressing roller is provided to the peeling portion to bias the label paper to maintain a certain path angle at the peeling portion (JP-A-10-077015, for example).

However, when the peeling devices to which the above-described technologies in the related art have been adopted are applied to ink jet printers, the driving speed of the roller on the downstream side may generate a slip between the roller and the label paper. This may cause adverse effects on the transport accuracy of paper.

Moreover, contact of the roller with the printed surface of the label immediately after the printing may reduce the print quality.

Furthermore, for ink jet printers, various types of label paper may be used because ink jet printers have few limitations on media characteristics in comparison with thermal head printers. When similar tension is applied, thick and hard label paper may make a path angle at the peeling portion large in comparison with thin and soft label paper, which may cause adverse effects on the accuracy of peeling. Therefore, relatively large tension needs to be applied to thick and hard label paper to peel off the labels appropriately. In this case, adopting the above-described technique requires the driving speed of the roller on the downstream side to be faster or biasing force to the pressing roller to be greater. When thin and soft label paper is used in light of the above, the label paper may be damaged.

SUMMARY

In light of the foregoing, an advantage of some aspects of the invention is to provide a peeling device and ink jet printer capable of transporting label paper and peeling off a label from backing paper in accordance with the paper type of the label paper.

According to one embodiment, a peeling device is configured to peel off a printed label printed by an ink jet printer from a backing paper transported from the ink jet printer, to which the printed label attached. The peeling device includes a driving roller configured to transport the backing paper, a drive transmission mechanism configured to transmit driving force from a driving motor to the driving roller, and a peeling portion located between the driving roller and a printing section configured to perform printing in a transport path of the backing paper. The transport path bends along the peeling portion. The drive transmission mechanism includes a first torque limiter with first torque and a second torque limiter with a second torque which is different from the first torque, and is configured to take a first state in which the first torque limiter is included between the driving roller and the driving motor in a transmission system of the driving force and a second state in which the second torque limiter is included between the driving roller and the driving motor in the transmission system.

According to the embodiment, switching the torque limiters in accordance with the paper type of the label paper allows the label paper to be transported with an appropriate torque in accordance with the paper type. This configuration can apply appropriate tension to the label paper to prevent the label paper from loosening and floating during transport and allow the label to be peeled off smoothly.

In a peeling device according to another embodiment, the drive transmission mechanism includes a transmission gear that couples to the driving roller and is configured to move to a first position where the transmission gear couples to the first torque limiter and a second position where the transmission gear couples to the second torque limiter.

According to the embodiment, moving the transmission gear to the first position or the second position allows for ready switching between the first state and the second state.

In a peeling device according to another embodiment, the peeling device further includes an operating portion operated by a user. The transmission gear moves to the first position or the second position according to operation to the operating portion.

According to the embodiment, operating the operating lever moves the transmission gear to the first position or the second position, allowing for ready switching between the first state and the second state with the operating lever.

In a peeling device according to another embodiment, the peeling device is configured to acquire paper type information of the label paper. The drive transmission mechanism is brought into the first state or the second state in accordance with the paper type information.

According to the embodiment, acquiring the paper type information on the label paper allows the torque limiters to automatically switch between the first state and the second state in accordance with the paper type information on the label paper.

In another embodiment, an ink jet printer includes a printhead configured to print on a label attached to a backing paper, a driving roller configured to transport the backing paper, a drive transmission mechanism configured to transmit driving force from a driving motor to the driving roller, and a peeling portion located between the driving roller and a printing section configured to perform the printing in a transport path of the backing paper. The transport path bends along the peeling portion. The drive transmission mechanism includes a first torque limiter with a first torque and a second torque limiter with a second torque which is different from the first torque and is configured to take the first state in which the first torque limiter is included between the driving roller and the driving motor in a transmission system of the driving force and the second state in which the second torque limiter is included between the driving roller and the driving motor in the transmission system.

According to the embodiment, switching the torque limiters in accordance with the paper type of the label paper allows the label paper to be transported with an appropriate torque in accordance with the paper type. This configuration can apply appropriate tension to the label paper to prevent the label paper from loosening and floating during transport and allow the label to be peeled off smoothly.

BRIEF DESCRIPTION OF THE DRAWINGS

The invention will be described with reference to the accompanying drawings, wherein like numbers reference like elements.

DESCRIPTION OF EMBODIMENTS

An exemplary embodiment of the invention is described below with reference to the accompanying drawings.

Figure 1:
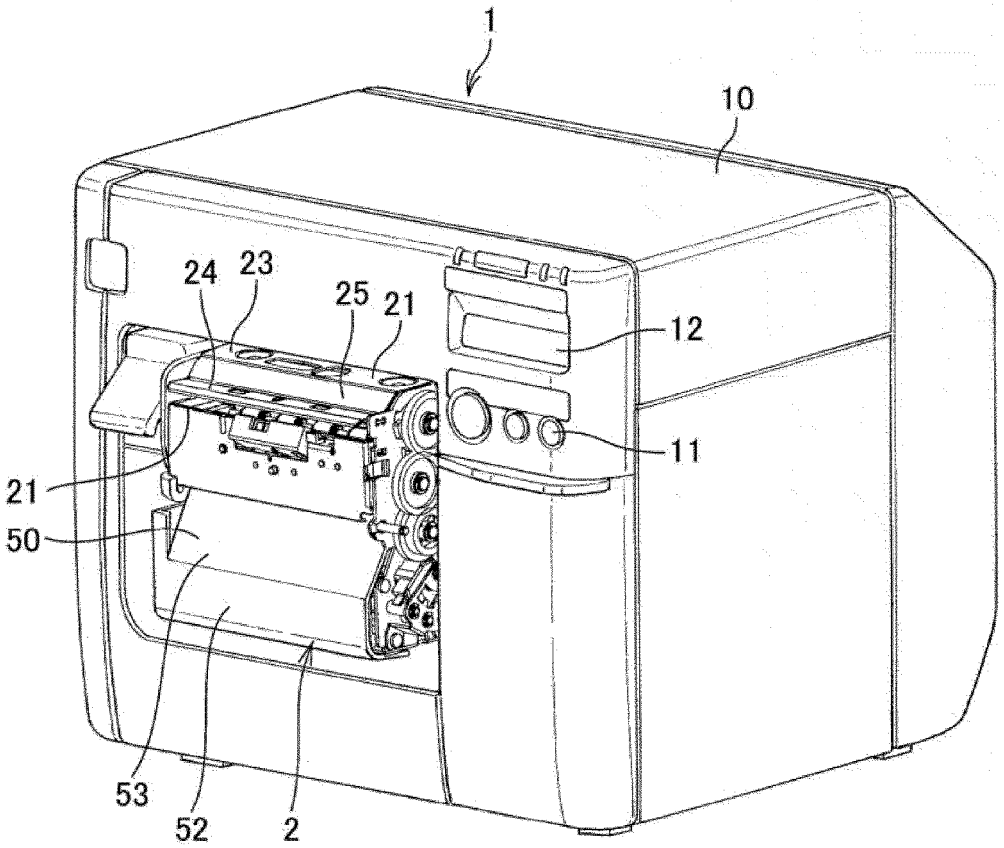
FIG. 1 is a schematic perspective view of an ink jet printer according to an exemplary embodiment of the invention.
Figure 2:
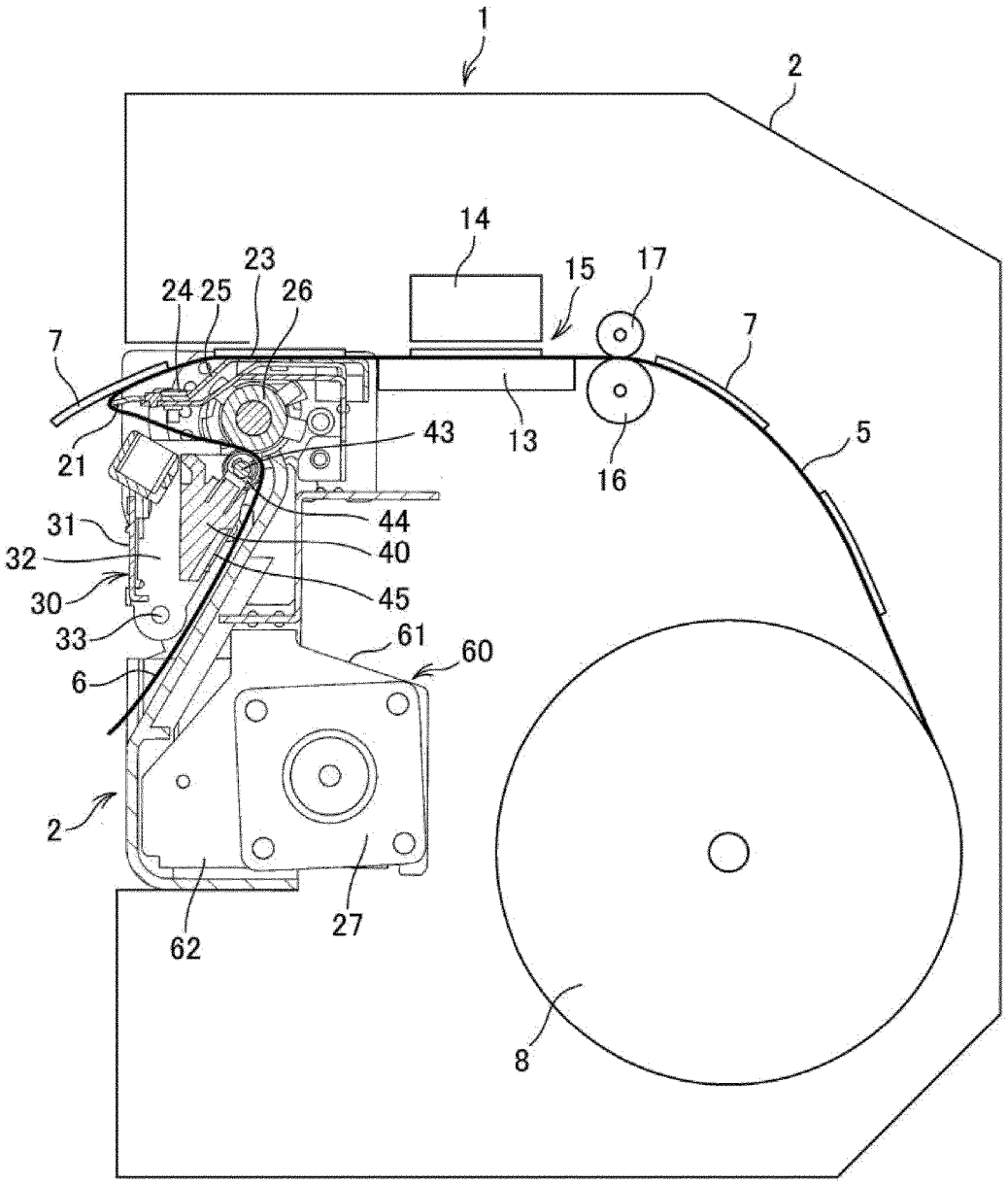
FIG. 2 is a schematic sectional view of the ink jet printer.
Figure 3:
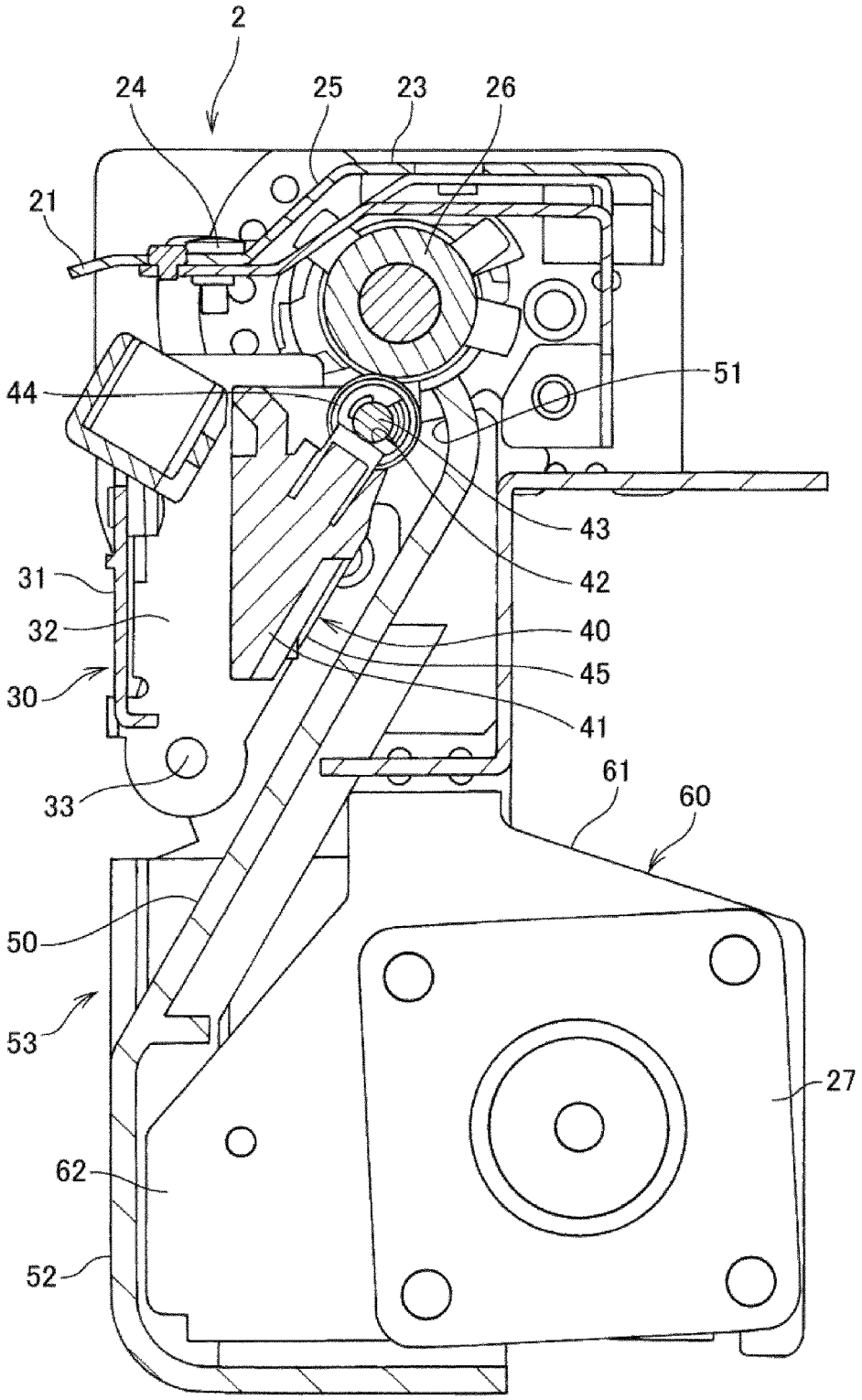
FIG. 3 is a schematic configuration diagram of a peeling device included in the ink jet printer.
Figure 4:
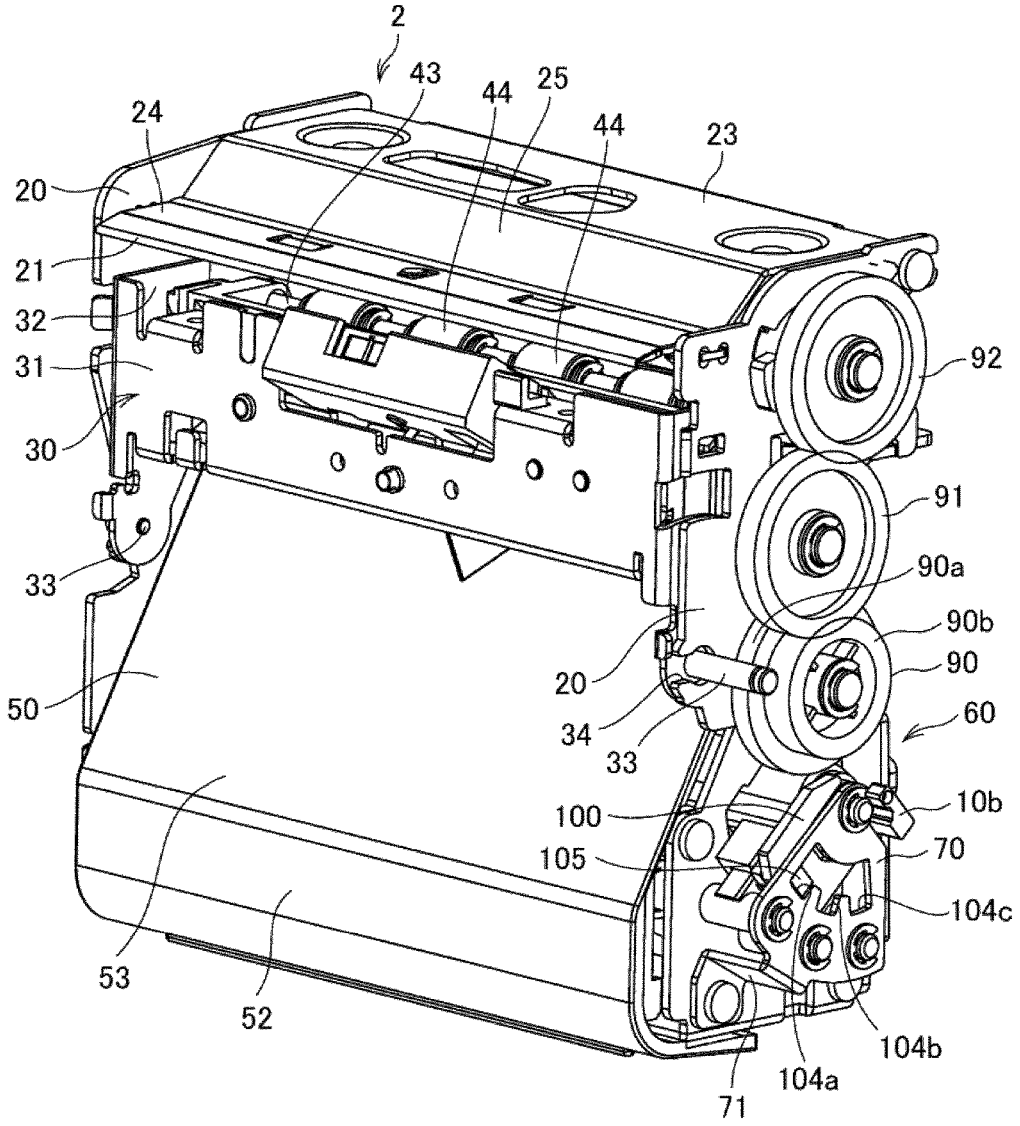
FIG. 4 is a schematic perspective view of the peeling device.

FIG. 1 is a schematic perspective view of a label printer 1 (an ink jet printer) according to the exemplary embodiment of the invention. FIG. 2 is a schematic sectional view of the label printer 1. FIG. 3 is a schematic configuration diagram of a peeling device 2 included in the ink jet printer. FIG. 4 is a schematic perspective view of the peeling device 2.

In the present exemplary embodiment, the label printer 1 performs printing on long label paper 5.

The label printer 1 records an image on the label paper 5 with the ink jet method on the basis of image data received from, for example, a computer (not illustrated) communicably connected to the label printer 1.

The label paper 5 includes continuous, belt-shaped backing paper 6 (liner) and a plurality of labels 7 attached to the backing paper 6. Any material can be used for the backing paper 6 and the labels 7. In the exemplary embodiment, the label paper 5 is provided in the form of paper roll 8, but is not limited to such a form. For example, fanfold paper may be used for the label paper 5.

The label printer 1 has a body casing 10 formed in a substantially rectangular parallelepiped shape. The body casing 10 has the peeling device 2 mounted on a front side thereof in a detachable manner.

The body casing 10 has an operation unit 11 and a display unit 12 disposed on an upper front side thereof. The operation unit 11 is used by a user to operate various functions of the label printer 1. The display unit 12 displays the operation state of the label printer 1.

As illustrated in FIG. 2, the body casing 10 has a platen 13 disposed on an upper inner side thereof. Above the platen 13, a printhead 14 is disposed with an ink nozzle surface thereof facing the platen 13. The position where the platen 13 and the printhead 14 are disposed is defined as a printing section 15.

The printhead 14 is mounted on a carriage (not-illustrated) movable along a guide shaft (not-illustrated). The carriage is driven by a carriage driving motor (not-illustrated) to reciprocate along the guide shaft. The driven carriage enables the printhead 14 to reciprocate in a direction perpendicular to the paper surface of FIG. 2.

The body casing 10 houses the paper roll 8 on a lower inner side thereof. The paper roll 8 is a roll of wound label paper 5. Between the roll 8 and the platen 13 in a transport path of the backing paper 6, a printer-side transport roller 16 is disposed and is driven to rotate by a motor (not-illustrated). Above the printer-side transport roller 16, a printer-side driven roller 17 pressed against the printer-side transport roller 16 is disposed. The label paper 5 pulled out from the paper roll 8 is transported to between the platen 13 and the printhead 14 by the rotational drive of the printer-side transport roller 16 with the label paper 5 interposed between the printer-side transport roller 16 and the printer-side driven roller 17.

The following describes the peeling device 2.

As illustrated in FIG. 3 and FIG. 4, the peeling device 2 includes a pair of side frames 20 facing each other and a peeling plate 21 (peeling portion) supported between the side frames 20.

The peeling plate 21 has an upper guide surface 23 at the height of the transport surface for the label paper 5 on the platen 13. Along the upper guide surface 23, the label paper 5 is transported. The label paper 5 transported along the upper guide surface 23 is bent by the peeling plate 21 toward a side of the backing paper 6 where no label 7 is attached. In the exemplary embodiment, the label paper 5 is bent downward in the vertical direction. At the peeling plate 21, the label 7 is peeled off from the backing paper 6 and discharged from a label exit (not-illustrated).

The tip of the peeling plate 21 located on the far side from the platen 13 is lower than the transport surface on the platen 13 in the vertical direction. The peeling plate 21 has a lower guide surface 24 and an oblique surface 25. The lower guide surface 24 is lower than the upper guide surface 23 in the vertical direction. The oblique surface 25 connects the upper guide surface 23 and the lower guide surface 24. The tip of the peeling plate 21 on the lower guide surface 24 located on the far side from the platen 13 is thus lower than the platen 13 in the vertical direction.

On the lower surface side of the upper guide surface 23 of the peeling plate 21, a driving roller 26 is disposed. The driving roller 26 is driven to rotate by a driving motor 27 (described later) with a specific torque.

On the upper front side of the side frames 20, a roller-support frame 30 is provided. The roller-support frame 30 includes a front plate 31 and a pair of side plates 32. Each of the side plates 32 of the roller-support frame 30 has a support shaft 33 at a lower end part thereof. In the side frames 20, support grooves 34 are formed for supporting the support shafts 33. With the support shafts 33 engaged with the support grooves 34 of the side frames 20, the roller-support frame 30 is swingable around the support shafts 33 forward of the body casing 10.

On the rear side of the roller-support frame 30, that is, inside of the body casing 10, a pressing roller unit 40 is detachably mounted.

The pressing roller unit 40 includes side part frames 41 on both sides thereof. Each of the side part frames 41 has a long support through-hole 42 formed therethrough. Between the support through-holes 42 of the side part frames 41, a roller shaft 43 is disposed. The roller shaft 43 is supported by the side part frames 41.

The roller shaft 43 has a pressing roller 44. The pressing roller 44 is a split roller including a plurality of rollers. At exposed portions between the rollers of the pressing roller 44 on the roller shaft 43, springs (not-illustrated) are provided. The springs bias the roller shaft 43 toward the driving roller 26. This configuration causes the pressing roller 44 to be pressed against the periphery of the driving roller 26, bringing the driving roller 26 and pressing roller 44 into a pair of interposing rollers.

Below the pressing roller 44, a guide 45 is provided extending to the lower end part of the pressing roller unit 40. On the surface of the guide 45, a plurality of ribs (not illustrated) are formed.

In the peeling device 2, a paper-discharge guide plate 50 is disposed facing the guide 45. The paper-discharge guide plate 50 is oblique so that an upper end thereof is positioned on the rear side of the peeling device 2 and a lower end thereof is positioned on the front side of the peeling device 2.

At the upper end of the paper-discharge guide plate 50, a curved surface 51 is provided. The curved surface 51 guides downward the backing paper 6 of the label paper 5 transported while being interposed between the driving roller 26 and the pressing roller 44. At the lower end of the paper-discharge guide plate 50, a cover 52 is provided. The cover 52 continuously covers the lower front surface and the bottom surface of the peeling device 2. The lower end part of the paper-discharge guide plate 50 is a backing-paper exit 53 that discharges the backing paper 6 of the label paper 5 to the outside.

The backing paper 6 of the label paper 5 is transported while being interposed between the driving roller 26 and the pressing roller 44, and guided downward by the curved surface 51. The backing paper 6 of the label paper 5 passes through between the guide 45 and the paper-discharge guide plate 50 and is then discharged from the backing-paper exit 53 to the outside.

Figure 5:
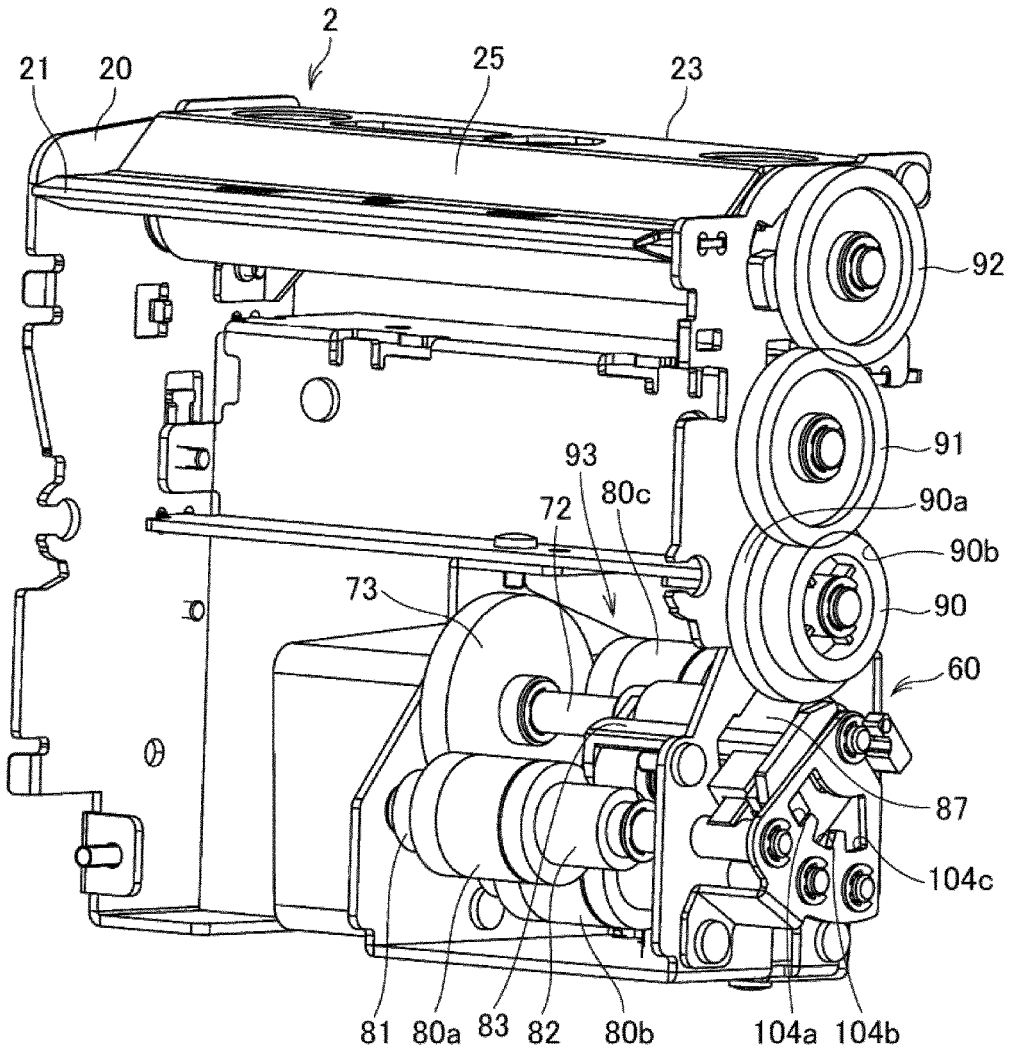
FIG. 5 is a perspective view of the peeling device from which a pressing roller unit has been removed.
Figure 6:
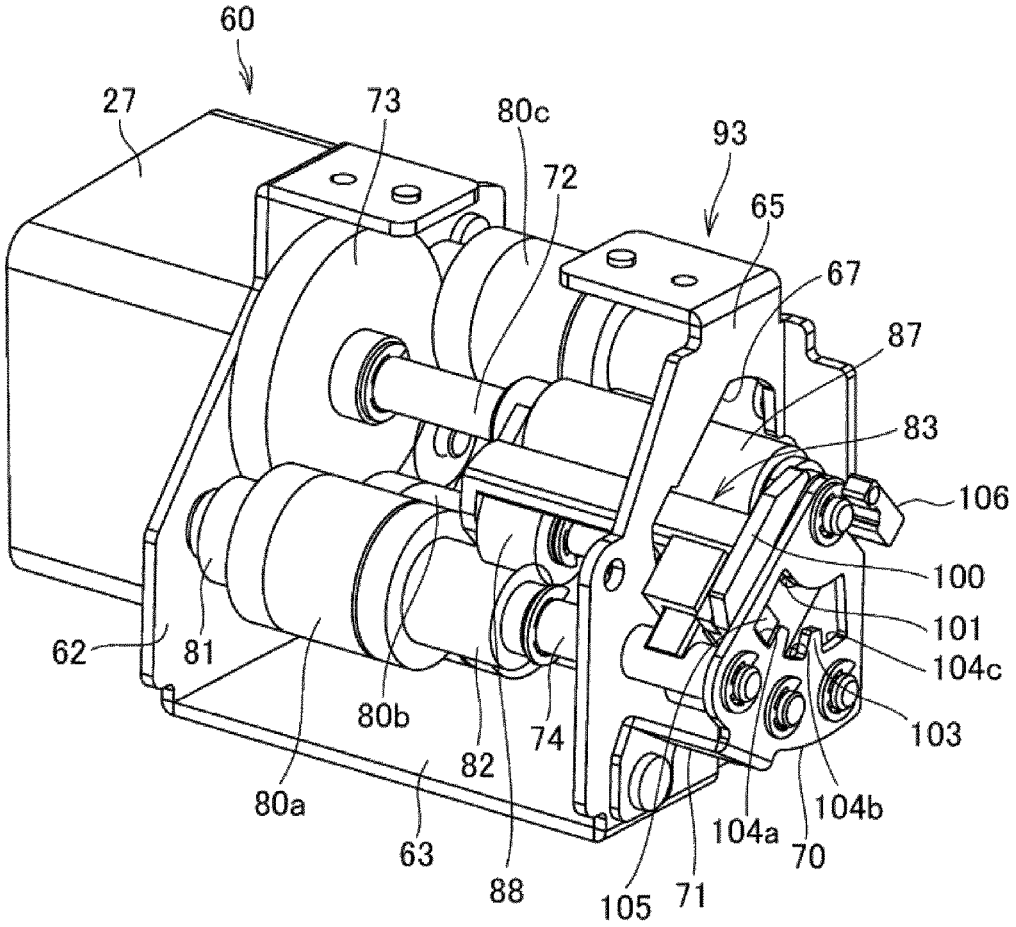
FIG. 6 is a front perspective view of a driving unit.
Figure 7:
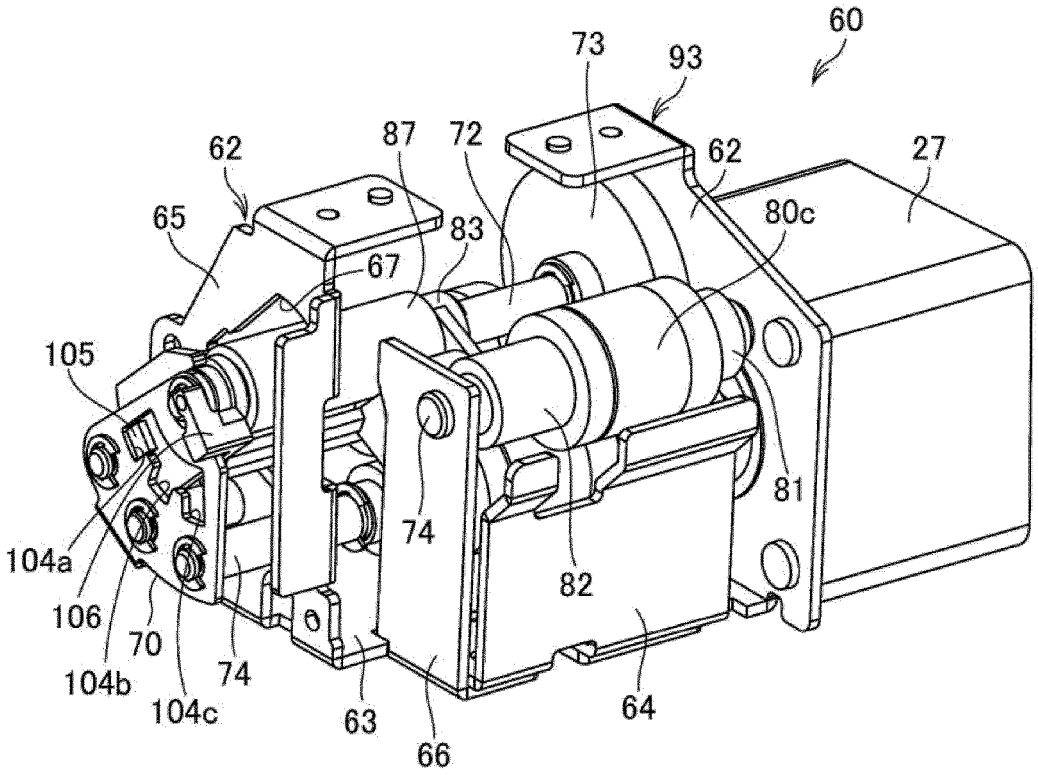
FIG. 7 is a rear perspective view of the driving unit.

The following describes a driving unit 60 with reference to FIG. 5 to FIG. 7. The driving unit 60 rotates the driving roller 26 with a driving force provided therefrom. FIG. 5 is a perspective view of the peeling device 2 from which the pressing roller unit 44 has been removed. FIG. 6 is a front perspective view of the driving unit 60. FIG. 7 is a rear perspective view of the driving unit 60.

The driving unit 60 includes the driving motor 27, a casing 61, and a drive transmission mechanism 93 provided in the casing 61. The casing 61 includes a first side plate 62, a second side plate 65 and a third side plate 66 each facing the first side plate 62.

In the exemplary embodiment, the driving motor 27 is installed to the first side plate 62. A stepping motor is used as the driving motor 27 in the exemplary embodiment. The space between the first side plate 62 and the second side plate 65 is greater than the space between the first side plate 62 and the third side plate 66.

Through the second side plate 65, an opening 67 is formed. On the outside of the second side plate 65, an substantially triangle-shaped stopper member 70 is disposed.

The stopper member 70 has a flange 71 formed in a crank shape at a lower end part thereof. The flange 71 is secured with a screw to the second side plate 65, causing the stopper member 70 to be fixed to the second side plate 65.

An output shaft 72 of the driving motor 27 is supported by the end part on the opposite side to the flange 71 of the stopper member 70. On a part of the output shaft 72 adjacent to the driving motor 27, a drive gear 73 is integrally installed. The drive gear 73 is included in the drive transmission mechanism 93.

Between the first side plate 62 and the second side plate 65, and between the first side plate 62 and the third side plate 66, three support shafts 74 are provided extending parallel to the output shaft 72. One of the supporting shafts 74 is supported at one end thereof by the first side plate 62 and at the other end by the third side plate 66. The output shaft 72 and the other two support shafts 74 are supported by the stopper member 70 and fixed to the second side plate 65.

Each of the support shafts 74 has a first torque limiter 80*a*, a second torque limiter 80*b*, or a third torque limiter 80*c* mounted thereon in a rotatable manner. The first torque limiter 80*a*, the second torque limiter 80*b*, and the third torque limiter 80*c* constitute a part of the drive transmission mechanism 93. Each of the torque limiters 80, that is, the first torque limiter 80*a*, the second torque limiter 80*b*, and the third torque limiter 80*c*, includes an inner ring, a coil spring, and an external component (none of them illustrated), for example. The torque limiter 80 has a mechanism which causes the inner ring and external component to co-rotate when a small torque is applied and causes the inner ring and external component to relatively rotate while maintaining a specific torque when a large torque is applied. In the exemplary embodiment, the torque limiters 80 are provided in a transmission system in which the driving force is transmitted from the driving motor 27 to the driving roller 26. This configuration can reduce landing deviation of ink on the label 7 during printing of the printhead 14 caused by the difference in rotation speed between the printer-side transport roller 16 and the driving roller 26.

In the exemplary embodiment, the torque limiters 80 have coil springs with different elastic forces.

The torque required to transport the label paper 5 varies depending on the paper type of the backing paper 6 of the label paper 5 such as the paper quality, paper thickness, and paper width. According to this embodiment, the label paper 5 can be transported with an appropriate torque in accordance with the paper type of the label paper 5.

In the exemplary embodiment, the torque difference between the torque limiters 80 is 100 g·cm (0.0098 N·m), for example.

Specifically, the first torque limiter 80*a* has the smallest torque and the second torque limiter 80*b* has a torque larger than that of the first torque limiter 80*a* by 100 g·cm. The third torque limiter 80*c* has a torque larger than that of the second torque limiter 80*b* by 100 g·cm.

On the input side of each of the torque limiters 80, a torque limiter input gear 81 that meshes with the drive gear 73 is integrally provided. On the output side of each of the torque limiters 80, a torque limiter output gear 82 is integrally provided.

The drive transmission mechanism 93 includes a gear train that transmits the force generated by the driving motor 27 to the driving roller 26. The drive transmission mechanism 93 includes the transmission system and a swing member 83. The transmission system has the drive gear 73, the torque limiter input gears 81, the torque limiters 80, the torque limiter output gears 82, a first transmission gear 88, a second transmission gear 89, an output gear 87, a double gear 90, a transmission gear 91, and a transport gear 92.

In the transmission system of the drive transmission mechanism 93, the driving force from the driving motor 27 is transmitted to the transport gear 92 through the drive gear 73, one of the torque limiter input gears 81, one of the torque limiters 80, one of the torque limiter output gears 82, the first transmission gear 88, the output gear 87, the double gear 90, and the transmission gear 91 in that order.

The swing member 83 is provided on the periphery of the output shaft 72 so as to be swingable around the output shaft 72.

The swing member 83 has the output gear 87 loosely fitted to the periphery side of the output shaft 72. The output gear 87 rotates coaxially with the output shaft 72. The output gear 87 partially protrudes from the opening 67 of the front side plate 65.

The swing member 83 has the first transmission gear 88 and second transmission gear 89 rotatably provided therein. Both the first transmission gear 88 and second transmission gear 89 mesh with the output gear 87. The swing of the swing member 83 allows the first transmission gear 88 to mesh with the torque limiter output gear 82 of the first torque limiter 80*a* or the torque limiter output gear 82 of the second torque limiter 80*b*. In other words, the swing of the swing member 83 allows the first transmission gear 88 to couple with the torque limiter 80*a* or the torque limiter 80*b*. The swing of the swing member 83 allows the second transmission gear 89 to mesh with the torque limiter output gear 82 of the third torque limiter 80*c*. In other words, the swing of the swing member 83 allows the second transmission gear 89 to couple with the torque limiter 80*c*.

Figure 8:
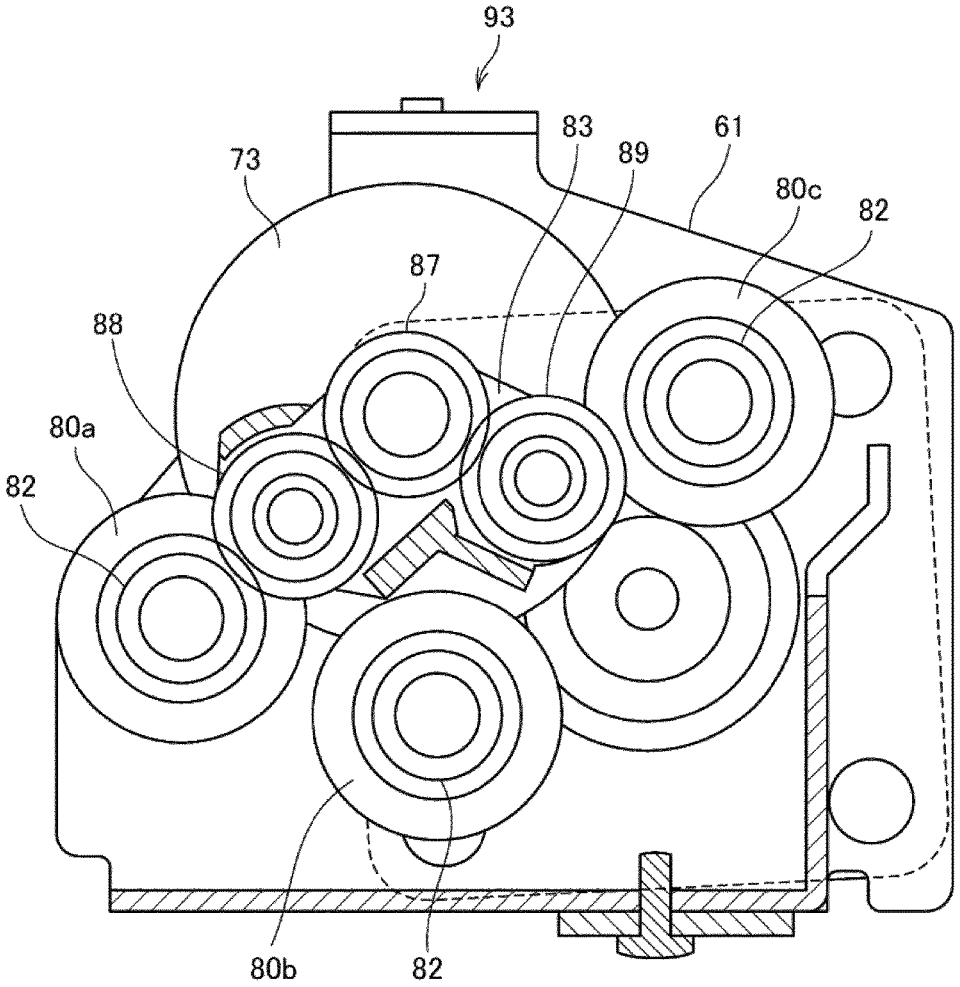
FIG. 8 is a side view of a drive transmission mechanism in a first state.
Figure 9:
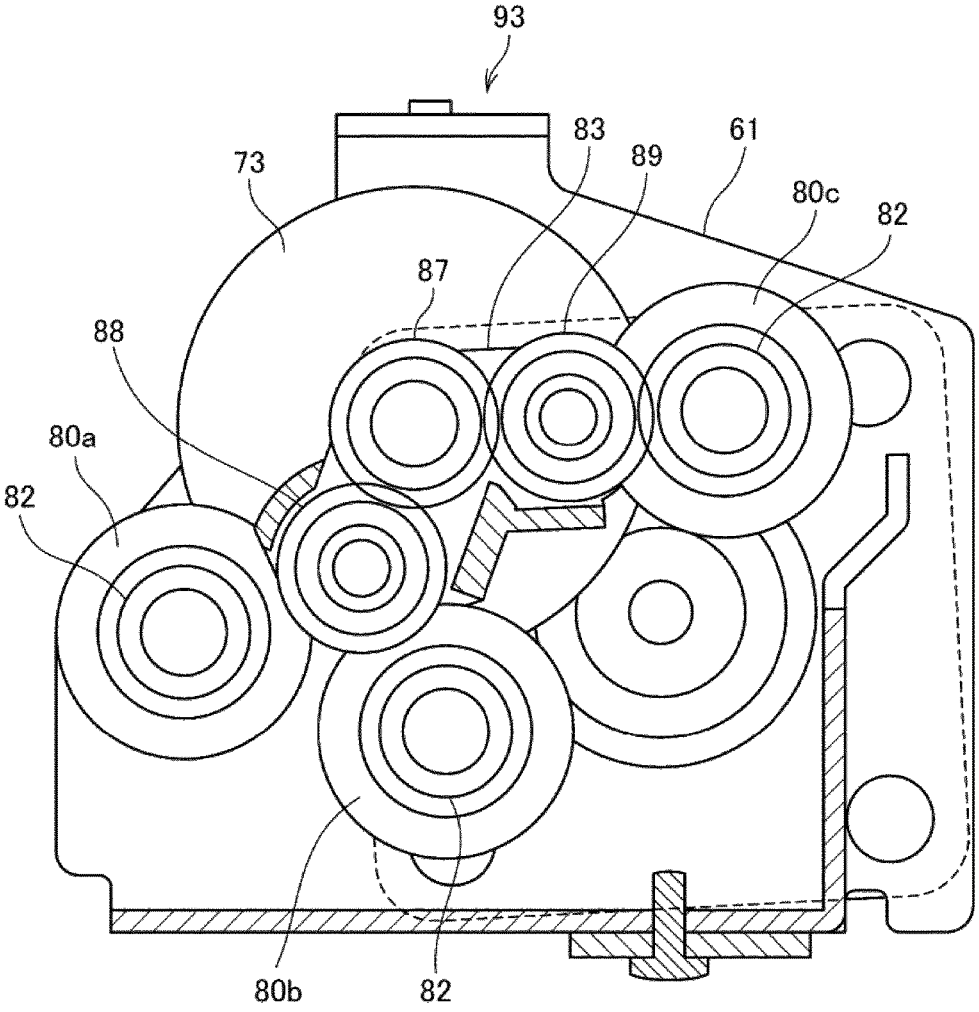
FIG. 9 is a side view of the drive transmission mechanism in a third state.
Figure 10:
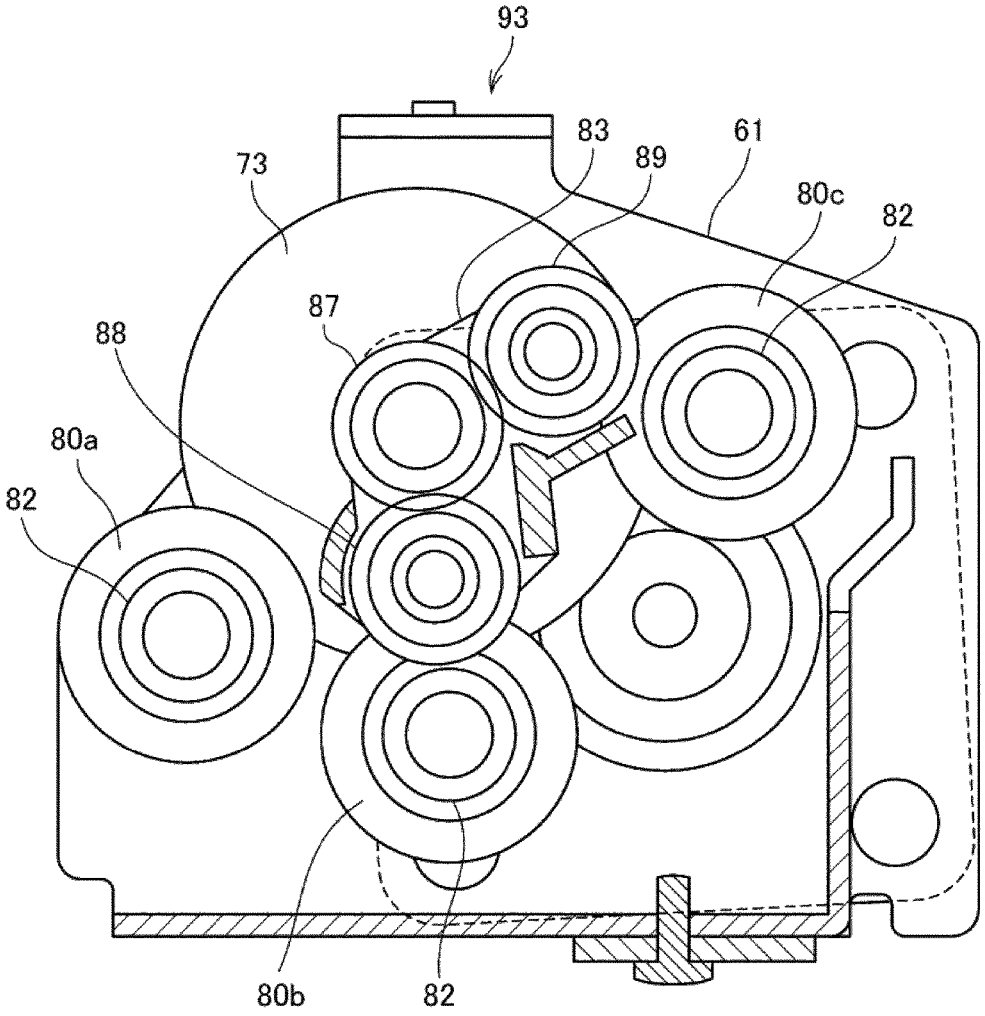
FIG. 10 is a side view of the drive transmission mechanism in a second state.

The following describes the motion of the swing member 83 in the drive transmission mechanism 93 with reference to FIG. 8 to FIG. 10. FIG. 8 is a side view of the drive transmission mechanism 93 in a first state. FIG. 9 is a side view of the drive transmission mechanism 93 in a third state. FIG. 10 is a side view of the drive transmission mechanism 93 in a second state. The swing member 83 illustrated in FIG. 8 swings to move the first transmission gear 88 to the position (the first position) where the first transmission gear 88 meshes with the torque limiter output gear 82 of the first torque limiter 80*a*. This brings the drive transmission mechanism 93 into the state (the first state) in which the first torque limiter 80*a* is included as the torque limiter 80 in the transmission system. That is, in the drive transmission mechanism 93 in the first state, the torque through the first torque limiter 80*a* drives the driving roller 26. The swing member 83 illustrated in FIG. 10 swings to move the first transmission gear 88 to the position (the second position) where the first transmission gear 88 meshes with the torque limiter output gear 82 of the second torque limiter 80*b*. This brings the drive transmission mechanism 93 into the state (the second state) in which the second torque limiter 80*b* is included as the torque limiter 80 in the transmission system. That is, in the drive transmission mechanism 93 in the second state, the torque through the second torque limiter 80*b* drives the driving roller 26. As described above, the swing of the swing member 83 moves the first transmission gear 88 between the first position and the second position.

FIG. 9 illustrates the state in which the second transmission gear 89 is at the position where the second transmission gear 89 meshes with the torque limiter output gear 82 of the third torque limiter 80*c*. As described above, the swing of the swing member 83 brings the drive transmission mechanism 93 into any one of the following states: the state in which the first torque limiter 80*a* is included in the transmission system; the state in which the second torque limiter 80*b* is included in the transmission system; and the state in which the third torque limiter 80*c* is included in the transmission system.

On the outside of the second side plate 65, the double gear 90 is provided. A large-diameter gear 90*a* of the double gear 90 meshes with the output gear 87 at the position protruding from the second side plate 65. A small-diameter gear 90*b* of the double gear 90 meshes with the transport gear 92 coupled coaxially to the driving roller 26 through the transmission gear 91.

To the end part of the swing member 83 adjacent to the stopper member 70, an operating lever 100 is installed as an operating portion. The user operates the operating lever 100 to swing the swing member 83, thereby bringing the drive transmission mechanism 93 into a state in which an intended torque limiter 80, that is, the first torque limiter 80*a*, the second torque limiter 80*b*, or the third torque limiter 80*c*, is included in the drive transmission mechanism 93.

The operating lever 100 is installed to the output shaft 72 through a long support hole 101. The support hole 101 causes the operating lever 100 to be swingable around the output shaft 72 and movable in the radial direction of the output shaft 72. The operating lever 100 is usually biased by a spring (not-illustrated), for example, in the direction the tip of the operating lever 100 moves away from the output shaft 72. Operating the operating lever 100 in the direction the tip of the operating lever 100 comes close to the output shaft 72 against the biasing force of the spring allows the operating lever 100 to move along the long support hole 101.

The stopper member 70 has an engaging opening 102. The upper and lower sides of the engaging opening 102 are formed in an arc shape around the output shaft 72. On the lower side of the engaging opening 102, two protrusions 103 are formed and three engaging grooves 104 defined by the protrusions 103 are formed. The engaging grooves 104 are a first engaging groove 104*a*, a second engaging groove 104*b*, and a third engaging groove 104*c*.

The operating lever 100 has an engaging protrusion 105 formed on the tip side thereof. The engaging protrusion 105 engages with the engaging grooves 104. The operating lever 100 has an operating protrusion 106 formed at the base end thereof.

The user operates the operating lever 100 to engage the engaging protrusion 105 of the operating lever 100 with the first engaging groove 104*a*. This operation enables, as illustrated in FIG. 8, the drive transmission mechanism 93 to maintain the first state in which the torque limiter output gear 82 of the first torque limiter 80*a* meshes with the output shaft 72 through the first transmission gear 88.

The user operates the operating lever 100 to engage the engaging protrusion 105 with the third engaging groove 104*c*. This operation enables, as illustrated in FIG. 10, the drive transmission mechanism 93 to maintain the second state in which the torque limiter output gear 82 of the second torque limiter 80*b* meshes with the output gear 87 through the first transmission gear 88.

The user operates the operating lever 100 to engage the engaging protrusion 105 with the second engaging groove 104*b*. This operation enables, as illustrated in FIG. 9, the drive transmission mechanism 93 to maintain the third state in which the torque limiter output gear 82 of the third torque limiter 80*c* meshes with the output gear 87 through the second transmission gear 89.

The switching between the states can be achieved by the user to operate the operating protrusion 106 to swing the operating lever 100 while moving the operating lever 100 along the support hole 101 in the radial direction of the output shaft 72. This operation allows the engaging protrusion 105 to climb over the protrusion 103, thereby changing the engagement of the engaging protrusion 105 with the engaging groove 104.

The switching for the torque limiters 80 between the first state, the second state, and the third state is achieved as follows: with the peeling device 2 removed from the label printer 1, operating the operating protrusion 106 to engage the engaging protrusion 105 of the operating lever 100 with any one of the engaging grooves 104.

The switch for the torque limiters 80 may be performed when the paper roll 8 is replaced, for example. Specifically, replacing the paper roll 8 changes the torque required for transporting the backing paper 6 depending on the paper type such as the thickness and width of the backing paper 6 of the newly installed paper roll 8. The user accordingly switches the torque limiters 80 in accordance with torque required for the newly installed paper roll 8.

For example, with a configuration in which the operating lever 100 is automatically operated by a motor or the like, acquiring paper type information on the label paper 5 allows the torque limiters 80 to be automatically switched between the first state, the second state, and the third state in accordance with the paper type information on the label paper 5.

In such a configuration, the paper type information on the label paper 5 may be automatically acquired through a sensor, for example. The paper type information on the label paper 5 may also be acquired through a user's operation on the operation unit 11, such as selecting or inputting operation.

In the peeling device 2, the driving roller 26 driven by the driving motor 27 is driven to rotate at the rotational speed higher than that of the printer-side transport roller 16. The driving roller 26 is rotated with the torque transmitted through the torque limiter 80 selected by the user.

Such a drive operation causes the transport amount of a position printed by the printhead 14 on the label paper 5 to be controlled by the rotation of the printer-side transport roller 16, allowing the driving roller 26 to constantly apply specific tension to the backing paper 6 of the label paper 5. The application of the specific tension to the backing paper 6 allows the backing paper 6 to be transported along the peeling plate 21 while being bent at an acute angle at the tip of the peeling plate 21. As a result, the labels 7 can be smoothly peeled off from the backing paper 6. Furthermore, floating of the label paper 5 can be reduced that may occur on the upstream side of the tip of the peeling plate 21.

In the exemplary embodiment, the drive transmission mechanism 93 includes the three torque limiters 80 with different torques, and the driving roller 26 is driven with different torques in the first state, the second state, and the third state. The invention, however, is not limited to such an exemplary embodiment. With at least two torque limiters 80, the driving roller 26 can be driven with two different torques. Furthermore, four or more torque limiters may be provided.

The following describes the advantageous effects of the exemplary embodiment.

Firstly, with the peeling device 2 removed from the label printer 1, the operating protrusion 106 is operated in accordance with the paper type such as the thickness and width of the backing paper 6 of the paper roll 8 used, causing the engaging protrusion 105 of the operating lever 100 to engage with any one of the first engaging groove 104*a*, the second engaging groove 104*b*, and the third engaging groove 104*c*.

The label printer 1 receives image data from the computer (not illustrated) communicably connected to the label printer 1. The label printer 1 drives the motor (not illustrated) to rotate the printer-side transport roller 16.

As a result, the label paper 5 pulled out from the paper roll 8 is transported to between the platen 13 and the printhead 14 while being interposed between the printer-side transport roller 16 and the printer-side driven roller 17.

The printhead 14 is driven in accordance with the image data and performs printing on the labels 7 of the label paper 5 transported onto the platen 13.

The label paper 5 is transported to the peeling plate 21 after the printing by the printhead 14. At this time, the backing paper 6 of the label paper 5 is transported through the transport path while being interposed between the driving roller 26 and the pressing roller 44 located on the downstream side of the peeling plate 21. The backing paper 6 is then transported while being bent at an acute angle by the peeling plate 21. This operation peels off the labels 7 from the backing paper 6 of the label paper 5 and discharges the labels 7 from the peeling device 2.

On the other hand, the backing paper 6 is transported while being interposed between the driving roller 26 and the pressing roller 44, and guided downward by the curved surface 51. The backing paper 6 passes through between the guide 45 and the paper-discharge guide plate 50 and is then discharged from the backing-paper exit 53 to the outside.

According to the exemplary embodiment of the invention, the peeling device 2 includes the driving roller 26 that transports the backing paper 6 and the drive transmission mechanism 93 that transmits the driving force from the driving motor 27 to the driving roller 26. The peeling device 2 also includes the peeling plate 21 (the peeling portion) located between the driving roller 26, and the printhead 14 and platen 13 (the printing section 15) in the transport path of the backing paper 6. The peeling plate 21 bends the transport path. The drive transmission mechanism 93 includes the first torque limiter 80*a* and the second torque limiter 80*b*. The drive transmission mechanism 93 is capable of taking the first state and the second state. In the first state, the first torque limiter 80*a* is included between the driving roller 26 and the driving motor 27 in the transmission system of the driving force, and, in the second state, the second torque limiter 80*b* is included therebetween.

This configuration enables the torque limiter 80 included in the transmission system of the drive transmission mechanism 93 to be switched to any one of the first torque limiter 80*a*, the second torque limiter 80*b*, and the third torque limiter 80*c*, allowing the label paper 5 to be transported with an appropriate torque in accordance with the paper type of the label paper 5. This configuration can apply appropriate tension to the label paper 5 to prevent the label paper 5 from loosening and floating during transport and allow the labels 7 to be peeled off smoothly.

According to the exemplary embodiment, the drive transmission mechanism 93 includes the first transmission gear (the transmission gear) that couples to the driving roller 26, and the first transmission gear 88 can move to the first position where the first transmission gear 88 couples to the first torque limiter 80*a* and the second position where the first transmission gear 88 couples to the second torque limiter 80*b*.

This configuration causes the first transmission gear 88 to move to the first position or the second position, allowing for ready switching between the first state and the second state.

According to the exemplary embodiment, the drive transmission mechanism 93 includes the operating lever 100 (the operating portion) that moves the first transmission gear 88 to the first position or the second position.

This configuration enables the first transmission gear 88 to move to the first position or the second position through the operation of the operating lever 100, allowing for ready switching between the first state and the second state by the operating lever 100.

According to the exemplary embodiment, the paper type information on the label paper 5 is acquired, and the drive transmission mechanism 93 is brought into the first state or the second state in accordance with the acquired paper type information.

Accordingly, acquiring the paper type information on the label paper 5 allows the torque limiters 80 to automatically switch between the first state and the second state in accordance with the paper type information on the label paper 5.

While the exemplary embodiment according to the invention has been described, the invention is not limited to such an exemplary embodiment and may be variously modified as necessary.

This application claims priority under 35 U.S.C. § 119 to Japanese Patent Application No. 2016-129267, filed Jun. 29 2016. The entire disclosure of Japanese Patent Application No. 2016-129267 is hereby incorporated herein by reference.

What is claimed is:

1. A peeling device configured to peel off a printed label printed by an ink jet printer from a backing paper transported from the ink jet printer, to which the printed label attached, the peeling device comprising:

a driving roller configured to transport the backing paper;

a drive transmission mechanism configured to transmit driving force from a driving motor to the driving roller; and a peeling portion located between the driving roller and a printing section configured to perform the printing in a transport path of the backing paper, along which the transport path bends, wherein the drive transmission mechanism includes a first torque limiter with first torque and a second torque limiter with a second torque which is different from the first torque, and the drive transmission mechanism is configured to take a first state in which the first torque limiter is included between the driving roller and the driving motor in a transmission system of the driving force and a second state in which the second torque limiter is included between the driving roller and the driving motor in the transmission system.

2. The peeling device according to claim 1, wherein:

the drive transmission mechanism includes a transmission gear that couples to the driving roller, and the transmission gear is configured to move to a first position where the transmission gear couples to the first torque limiter and a second position where the transmission gear couples to the second torque limiter.

3. The peeling device according to claim 2, further comprising an operating portion operated by a user;

wherein the transmission gear moves to the first position or the second position according to operation to the operating portion.

4. The peeling device according to claim 2, configured to acquire paper type information of the label paper, wherein the drive transmission mechanism is brought into the first state or the second state in accordance with the paper type information.

5. The peeling device according to claim 1, configured to acquire paper type information of the label paper, wherein the drive transmission mechanism is brought into the first state or the second state in accordance with the paper type information.

6. An ink jet printer comprising:

a printhead configured to print on a label attached to a backing paper;

a driving roller configured to transport the backing paper;

a drive transmission mechanism configured to transmit driving force from a driving motor to the driving roller; and a peeling portion located between the driving roller and a printing section configured to perform the printing in a transport path of the backing paper, along which the transport path bends;

wherein the drive transmission mechanism:

includes a first torque limiter with a first torque and a second torque limiter with a second torque which is different from the first torque; and is configured to take a first state in which the first torque limiter is included between the driving roller and the driving motor in a transmission system of the driving force and a second state in which the second torque limiter is included between the driving roller and the driving motor in the transmission system.

7. The ink jet printer according to claim 6, wherein:

the drive transmission mechanism includes a transmission gear that couples to the driving roller, and the transmission gear is configured to move to a first position where the transmission gear couples to the first torque limiter and a second position where the transmission gear couples to the second torque limiter.

8. The ink jet printer according to claim 7, further comprising an operating portion operated by a user;

wherein the transmission gear moves to the first position or the second position according to operation to the operating portion.

9. The ink jet printer according to claim 7, configured to acquire paper type information of the label paper, wherein the drive transmission mechanism is brought into the first state or the second state in accordance with the paper type information.

10. The ink jet printer according to claim 6, configured to acquire paper type information of the label paper, wherein the drive transmission mechanism is brought into the first state or the second state in accordance with the paper type information.

* * * * *